US008373612B2

(12) United States Patent
Cook

(10) Patent No.: US 8,373,612 B2
(45) Date of Patent: Feb. 12, 2013

(54) ANTENNA INSTALLATION APPARATUS AND METHOD

(75) Inventor: Charles I. Cook, Louisville, CO (US)

(73) Assignee: Qwest Communications International Inc., Denver, CO (US)

( * ) Notice: Subject to any disclaimer, the term of this patent is extended or adjusted under 35 U.S.C. 154(b) by 278 days.

(21) Appl. No.: 12/792,869

(22) Filed: Jun. 3, 2010

(65) Prior Publication Data

US 2011/0298686 A1 Dec. 8, 2011

(51) Int. Cl.
*H01Q 1/12* (2006.01)
*H01Q 9/34* (2006.01)

(52) U.S. Cl. ..... 343/890; 343/874

(58) Field of Classification Search ..... 343/874, 343/878, 890, 891; 52/40, 111, 115; 74/89.23, 74/89.37; 40/601, 604; 248/125.2, 295.11; 362/403, 286, 431

See application file for complete search history.

(56) References Cited

U.S. PATENT DOCUMENTS

| | | | | |
|---|---|---|---|---|
| 5,570,546 | A | 11/1996 | Butterworth et al. | |
| 6,447,150 | B1 * | 9/2002 | Jen et al. | 362/403 |
| 6,665,968 | B2 * | 12/2003 | Jen | 40/601 |
| 7,004,043 | B2 * | 2/2006 | Erel et al. | 74/89.23 |
| 7,956,817 | B2 * | 6/2011 | Hager | 343/890 |
| 8,018,395 | B2 * | 9/2011 | Hager | 343/890 |
| 8,085,211 | B2 * | 12/2011 | Yang et al. | 343/766 |
| 2009/0135074 | A1 | 5/2009 | Yang et al. | |
| 2009/0224998 | A1 | 9/2009 | Hager | |

FOREIGN PATENT DOCUMENTS

EP 1198024 A1 4/2002

OTHER PUBLICATIONS

International Search Report and Written Opinion prepared by the U.S. Patent and Trademark Office as International Searching Authority for PCT International Patent Application No. PCT/US11/39094, mailed Oct. 14, 2011, 27 pages.

International Preliminary Report on Patentability prepared by the International Bureau of WIPO for PCT International Patent Application No. PCT/US11/39094, mailed Dec. 13, 2012, 7 pages.

* cited by examiner

*Primary Examiner* — Hoang V Nguyen
(74) *Attorney, Agent, or Firm* — Swanson & Bratschun, L.L.C.

(57) ABSTRACT

Methods and systems are disclosed for enabling installation of antennas in a cost effective and efficient manner. The methods and systems disclosed herein provide a hollow pole and an elevating mechanism, wherein the elevating mechanism can be used to position antenna equipment located in one or more capsules attached to the elevating mechanism. The antenna equipment may be attached to a removable power source located in the capsule or to a non-removable power source located at the base of the hollow pole. Additionally, the antenna equipment may also be attached to communications equipment adapted to communicate with one or more communications networks. In an embodiment disclosed herein, the capsules may be adapted to rotate around a one or more axis in response to received commands and/or in accordance with instructions stored on a memory module attached to the capsules.

25 Claims, 6 Drawing Sheets

200

ANTENNA INSTALLATION APPARATUS AND METHOD

Embodiments of the invention are related to infrastructure for providing telecommunication services and, in particular, related to installation of antennas.

BACKGROUND

As information based industries constitute an ever growing part of national economies in many developed as well as developing countries, telecommunication networks have become an essential part of national infrastructure. Especially in developed economies, businesses as well as societies are highly dependent on faster and easier access to information, entertainment, and education via the telecommunications networks. More specifically, given the mobility of users and businesses, wireless communication networks, such as PCS and cellular systems, are increasingly becoming a bigger and more important part of modern telecommunications networks.

Many wireless systems, such as, but not limited to, PCS and cellular systems, include a centralized mobile switching center (MSC) responsible for call routing, user location tracking, billing information, and connectivity with other communication systems. The MSC may be connected to base station controllers (BSCs), each of which supports one or more base transceiver stations (BTSs). Each BTS supports one or more cells or cell sectors based on the number and configuration of antennas supported by the BTS. Other cellular systems and non-cellular wireless systems and radio architectures are also contemplated. For example, one type of wireless system that may not comprise one or more of the above listed network components is a IMS (IP Multimedia Subsystem) network. In one embodiment, a customer may communicate with the wireless system through a wireless unit, such as a radio telephone, when the telephone is within the coverage range of a cell. When a call is placed, a circuit-switched or packet-switched connection may be established from the telephone, through the BTS and BSC, to the MSC. The MSC determines the destination and, if the destination is to another telephone within the wireless system, may establish a circuit-switched (or a packet-switched) connection to the destination telephone. If the destination is outside of the wireless system, the MSC routes the call to a service provider for the outside destination.

A key component in any wireless communication system is the antenna forming the edge contact between wireless subscribers and the remaining system. Wireless communication antennas are usually elevated to provide increased coverage range. For example, such wireless communication antennas may be part of a BTS that communicates with wireless units, such as radio telephones, etc. Directional antennas are often used to form coverage areas or sectors. Multiple antennas can then be located at one site to provide geographic multiplexing. Often, existing structures such as buildings, towers, utility poles, light poles, and the like provide the necessary elevation. However, quite often it is also necessary that a new pole structure may be erected specifically for installation of such antennas.

When a new antenna location is established, various electrical connections with the antennas must be made. One type of connection carries signals between the antennas and associated transceivers. If transceivers are mounted with the antennas, power cabling and cabling for interconnection with the supporting base station must be provided. This cabling is typically run from the elevated antenna location to pedestals or boxes located on the ground or near the bottom of a pole or tower supporting the antenna. The box provides a convenient location for making power and signal connections.

Traditionally, the transceivers are attached to antenna poles specifically designed for mounting the transceivers/antennas by fixed locations on such poles. Moreover, generally the antennas are located on the top of the poles and the transceivers are attached on one or more transceiver boxes located on the side or at the base of the poles. As a result, when a transceiver and/or and antenna is to be attached to the pole, special equipment and personnel are required to mount the transceiver and/or antenna equipment at a desired location along the height of the pole. Therefore, there is a need for a better system that allows easy installation of antenna equipment and interconnecting of the antenna equipment with transceiver, power supply, and other necessary peripherals. Moreover, when the antenna equipment is located at an elevated location on a pole, such as a utility pole, the equipment is often exposed to environmental stress such as temperature swings, etc., and there is a need for a better solution that protects the antenna equipment from such factors.

BRIEF SUMMARY

Among other things, embodiments of the invention include methods, systems, and devices for providing telecommunication services. Particularly, methods and systems are disclosed for enabling installation of antennas and/or radio equipment in a cost effective and efficient manner. The methods and systems disclosed herein provides a hollow pole for housing an elevating mechanism, wherein the elevating mechanism can be used to position antenna equipments located in one or more capsules attached to the elevating mechanism. The antenna equipments may be attached to a removable power source located in the capsule or to a non-removable power source located at the base of the hollow pole. Additionally, the antenna equipment may also be attached via a communications cable with one or transceivers, which in turn may be interconnected with one or more telecommunications networks. In an embodiment disclosed herein, the capsules may be adapted to rotate around a central axis in response to commands received in a wireless manner or in accordance with instructions stored on a memory module attached to the capsules.

In an alternate embodiment, the elevating mechanism further comprises an elevation control mechanism attached to the elevating mechanism, wherein the elevation control mechanism is adapted to receive elevational information and to move the capsule in response to the elevational information. Thus, a user may be able to provide instructions about the desired elevation of the capsule to the elevation control mechanism and in response to such information, the elevation control mechanism elevates the capsule to the desired location.

In yet alternate embodiment, the capsule further comprises a removable power source and a wireless signaling mechanism that measures the power level of the removable power source and transmits a wireless signal including information about the power level measurement. In an alternate embodiment, the capsule further comprises a memory module for storing information about axial position of the capsule and an axial rotation module adapted to rotate the capsule around an axis based on the information about axial position of the capsule. The memory module may be further adapted to store information about elevation position of the capsule and to transmit the information about elevation position to the elevating mechanism.

An alternate embodiment disclosed herein provides a method of installing an antenna, the method comprising providing a hollow pole having a base end and a top end, providing an aperture located along a side of the hollow pole, providing an elevating mechanism inside the hollow pole, inserting a first antenna in a first capsule, inserting the first capsule into the hollow pole through the aperture, attaching the first capsule to the elevating mechanism, and elevating the first capsule from near the base end of the hollow pole to near the top end of the hollow pole. In an alternate embodiment, the method may further include inserting a second antenna in a second capsule, inserting the second capsule into the hollow pole through the aperture, attaching the second capsule to the elevating mechanism, and elevating the second capsule from near the base end of the hollow pole to near the top end of the hollow pole.

BRIEF DESCRIPTION OF THE DRAWINGS

A further understanding of the nature and advantages of the present invention may be realized by reference to the figures, which are described in the remaining portion of the specification. In the figures, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

DETAILED DESCRIPTION

In the following description, for the purposes of explanation, numerous specific details are set forth in order to provide a thorough understanding of the present invention. It will be apparent, however, to one skilled in the art that the present invention may be practiced without some of these specific details. For example, while various features are ascribed to particular embodiments, it should be appreciated that the features described with respect to one embodiment may be incorporated with other embodiments as well. By the same token, however, no single feature or features of any described embodiment should be considered essential to the invention, as other embodiments of the invention may omit such features. Further, while various embodiments may be described with reference to the Internet, embodiments of the invention may be implemented in any network.

Figure 1:
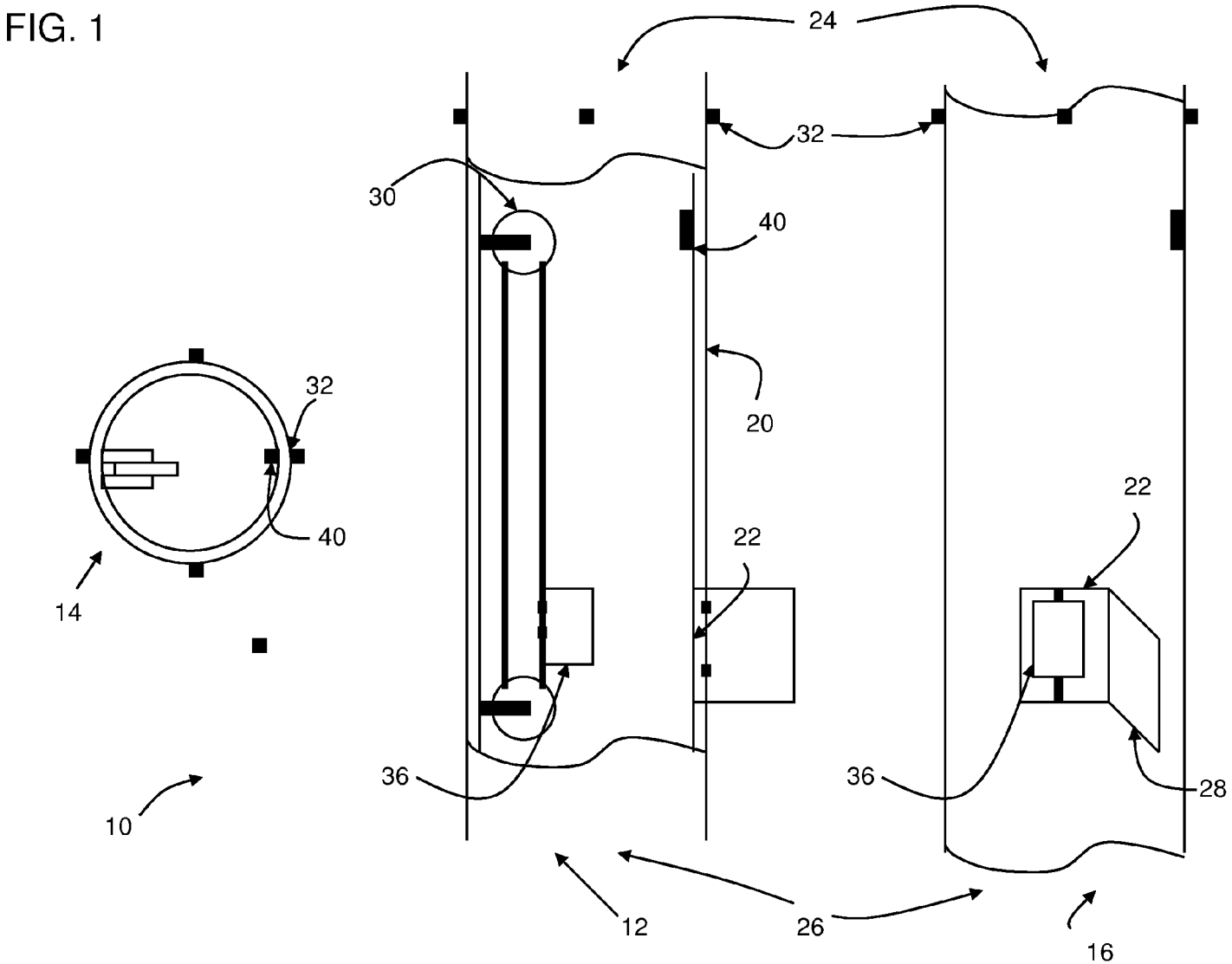
FIG. 1 illustrates a diagram of a pole structure for antenna installation according to one embodiment of the invention.

Referring now to FIG. 1, it illustrates a simplified diagram of an embodiment of a pole structure 10 for antenna installation. Specifically, the pole structure 10 is illustrated by an elevation view 12, a top view 14, and a side view 16. As shown in the elevation view 12, the pole structure 10 is a hollow pole with one or more walls 20 that may be made of any of the commonly known material for utility poles, etc. The pole structure 10 also has two ends, the top end 24 and the base end 26. One or more apertures 22 in the wall 20 near the base end 26 may be provided with a closing mechanism, such as a door 28. An elevating mechanism 30 may be attached to the inside wall of the pole structure 10. Moreover, the elevating mechanism 30 may be designed in a manner so as to removably attach to a capsule module 36, wherein the capsule module 36 may contain radio antenna and other equipment.

The elevating mechanism 30 may be implemented using any of the commonly known mechanisms such as a pulley and rope mechanism, a pulley and belt mechanism, a gear and chain mechanism, etc. Alternate forms of elevating mechanisms such as compression or tension based elevating mechanisms, hydraulic mechanisms, and magnetic systems, also may be used. The elevating mechanism 30 may include communication cables or power cables therewith so that when the capsule module 36 is attached to the elevating mechanism 30, it can be communicatively connected to such communication cables and to the power cables.

In yet another embodiment of the pole structure 10, the elevating mechanism 30 may be operatively coupled to one or more tracks installed on the internal surface of the one or more walls 20. In one such embodiment, a movable platform may be attached to one or more tracks so that the movable platform may be able to move up and down along the length of the pole structure 10. Alternatively, one or more rings may be attached to the track so that the rings may be able to move up and down along the length of the pole structure 10. Each of such rings may be able to attach to the capsule module 36 in a manner so that it may move the capsule module 36 up or down along the length of the pole structure 10. In an alternate embodiment, such tracks may include communication cables or power cables therewith so that when the capsule module 36 is attached to the tracks, it can be communicatively connected to such communication cables and to the power cables.

The pole structure 10 may be designed in a manner so that it may stand alone by itself or it may be used together with a pedestal or a support base. For example, the base end 26 may be attached to a larger support base that may be installed in the ground. Such larger support base may be removably attached to the base end by any of the commonly known attachment mechanisms, such as by clamps, by hooks, by thread-in mechanism, etc. In alternate embodiments, the pole structure 10 may be substantially permanently or irremovably attached to such a support base.

In an embodiment, the pole structure 10 may be tapered in design so that it is wider near the base end 26 and narrower near the top end 24. Such tapered design may provide the pole structure 10 with higher stability compared to un-tapered design. The pole structure 10 may be available in various lengths so that it may be installed on the ground or on top of another structure such as a building, etc. Moreover, in an alternate embodiment, the one or more walls 20 of the pole structure may be made of different material at different elevations. Thus, for example, the wall 20 near the top end 24 may be made of a material that does not attenuate or minimally attenuates electromagnetic signals, whereas the wall 20 near the base end 26 may be made of a separate material than the material comprising the wall 20 near the top end 24, with the wall 20 near the base end 26 also being structurally sturdier than the wall 20 near the top end 24.

The pole structure 10 may be provided with a radome attachment mechanism near the top end 24. While a number of different types of radome attachment mechanisms are possible, in FIG. 1 the pole structure 10 is provided with hooks 32 on the outer surface of the wall 20. The design and installation of such radome attachment mechanism may depend on the type of radome to be connected to the pole structure 10. As known to one of ordinary skill in the art, a radome is a structural, weatherproof enclosure that protects a microwave or radar antenna. A radome is generally constructed of material that minimally attenuates the electromagnetic signal transmitted or received by the antenna. In other words, the radome is transparent to radar or radio waves. Radomes can be constructed in several shapes (spherical, geodesic, planar, etc.) depending upon the particular application using various construction materials (fiberglass, PTFE-coated fabric, etc.). Moreover, the radomes also protect antenna surfaces from the environment (e.g., wind, rain, ice, sand, ultraviolet rays, etc.). Thus, attaching a radome with the pole structure 10 protects the antenna and various other equipments located inside the pole structure 10 from the environment. While FIG. 1 illustrates the hooks 32 to be located on the outside surface of the wall 20, in an alternate embodiment the hooks 32 may also be located on the inside surface of the wall 20.

The pole structure 10 disclosed herein may be especially useful when an installation of antenna and related peripherals is required on top of a high rise building or at other such locations where it may be relatively difficult to utilize hoisting devices such as a crane, a bucket truck, etc. Due to the hollow nature of the pole structure 10, it may weigh less than conventional poles used for installation of antenna equipment, and therefore it may be easier to install into such locations. Similarly, the hollow structure of the pole structure 10 also results in lower use of material, therefore, providing cost benefits as well as being more environmentally-friendly.

In an alternate embodiment, the pole structure 10 may also include one or more capsule module stations 40, such as capsule mounting sockets, located near the top end 24. Such capsule module stations 40 may be used to substantially permanently hold the capsule modules 36. As a result a user is able to use the elevating mechanism 30 to elevate and position a number of capsule modules 36 in a single pole structure 10. The capsule module stations 40 may be provided with their own power connections, communicative cable connections, etc., so that once a capsule module 36 is positioned with a capsule module station 40, it can be connected to such power connections and/or the communicative cables.

In an alternate embodiment the pole structure 10 may be only partially hollow. Thus for example, in an embodiment, the bottom part of the pole structure 10 may in fact be solid so as to give more stability to the pole structure 10 when it is attached to a base. Whether the pole structure 10 is partially hollow of completely hollow, such a pole structure 10 with the elevating mechanism may allow technicians to install antenna equipment from the ground level, thus eliminating the cost and complexities of using a bucket truck traditionally used to install antenna equipment on at higher elevations. Moreover, because the antenna equipment is securely located inside the capsule modules 36 located inside the hollow poles the antenna equipment is more secure and less likely to be vandalized and/or adversely affected by environmental conditions.

Figure 2:
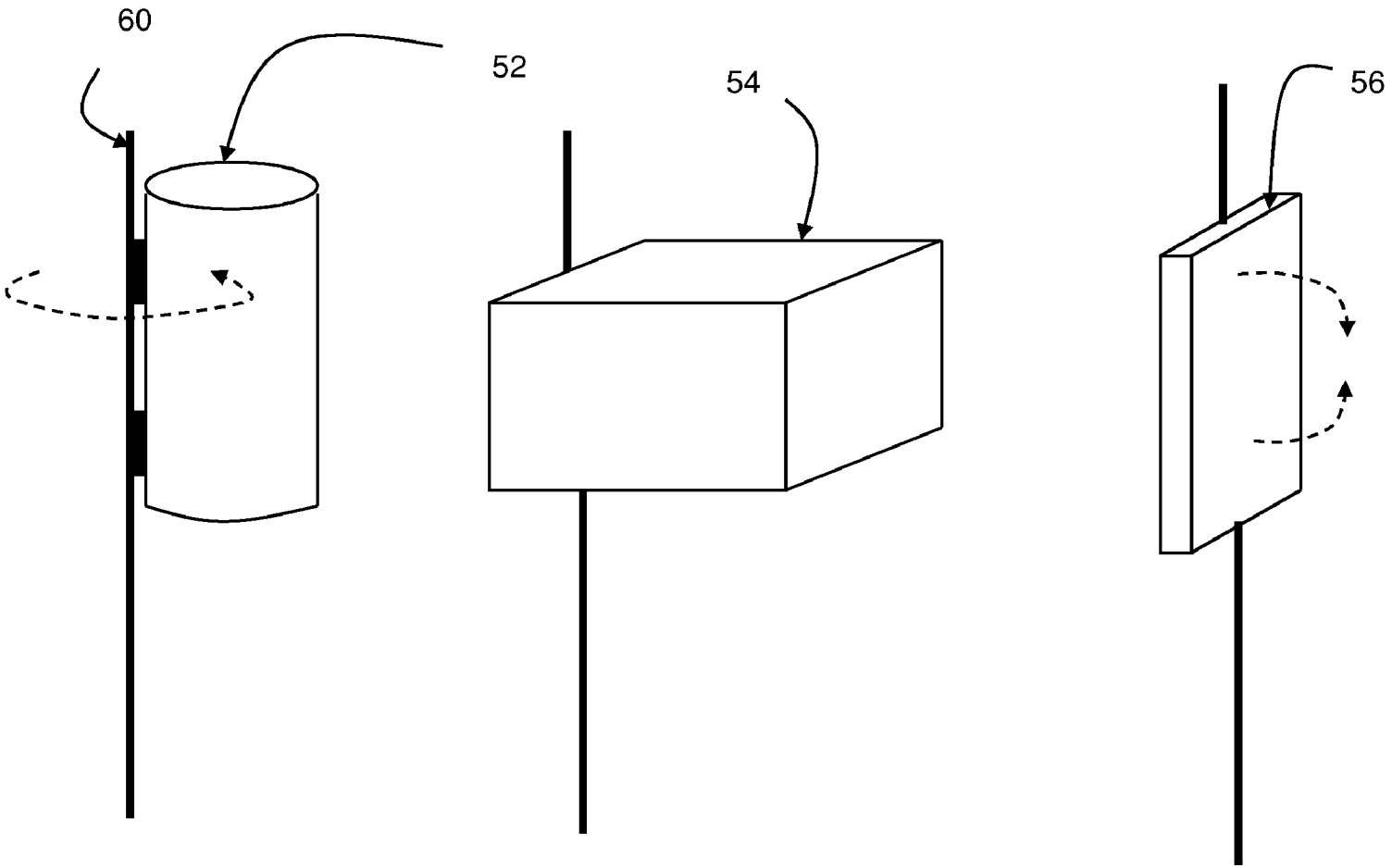
FIG. 2 illustrates shapes for a housing used to house a capsule module of FIG. 1 according to one or more embodiments of the invention.

Referring now to FIG. 2, with continued reference to FIG. 1, FIG. 2 illustrates a plurality of potential structural shapes for a housing used to house the capsule module 36 of FIG. 1. Specifically, FIG. 2 illustrates a cylindrical housing 52, a rectangular housing 54, and a planar housing 56. Each of these housings 52, 54, and 56 may be attached to a rope 60 (or a cable, belt, chain, etc.) that is part of the elevating mechanism 30, such as a pulley and rope mechanism, a gear and chain mechanism, etc. While in FIG. 2 the housings 52, 54, and 56 are illustrated as attached to the rope 60, in an alternate embodiment the housing may be attached to a track elevating mechanism installed in the pole structure 10.

Specifically, the housing 52 may be a cylindrical housing that is attached to the rope 60 via a hinge or other connecting mechanism. The housing 52 may be designed in a manner so that it may be able to rotate axially around the rope 60, as seen by the substantially circular arrow around the rope 60 in FIG. 2. Similarly, the other housings 54 and 56 may also be designed to rotate axially around the rope 60. Allowing the housings 52, 54, and 56 to rotate axially allows a user or a system to focus the radio antenna installed in such housing in a desired direction. The housing 52 may be provided with appropriate opening and closing mechanisms so that a user may install or change a radio antenna and/or any related equipment located within the housing, as necessary.

The housing 56 in the shape of an open-faced planar board may be used to house one or more antennas and related equipment. Additionally, the housing 56 may be attached to the rope 60 in a manner so that it may be able to rotate at an angle from the rope 60, as seen by the arrows extending away from the housing 56 in FIG. 2. Similarly, the other housings 52 and 54 may also be designed to rotate at a similar angle to the rope 60. Other angles are also contemplated. Allowing at least a portion of the housings 52, 54, and 56 to rotate at an angle away from the rope 60 allows a user or a system to focus the radio antenna installed in such housing at a desired angle adapted to provide a better signal reception.

Each of the housings 52, 54, and 56 may be designed to house one or more portable power supplies such as, but not limited to, a battery, etc., that may be used to power a radio antenna and other related equipment installed therein. Moreover, in a particular embodiment, the elevating mechanism 30 may be designed in a manner so that a plurality of housings 52, 54, or 56 may installed on the same rope 60 (or chain, cable, etc). In such a case a number of antennas may be installed in a single pole structure 10.

Figure 3:
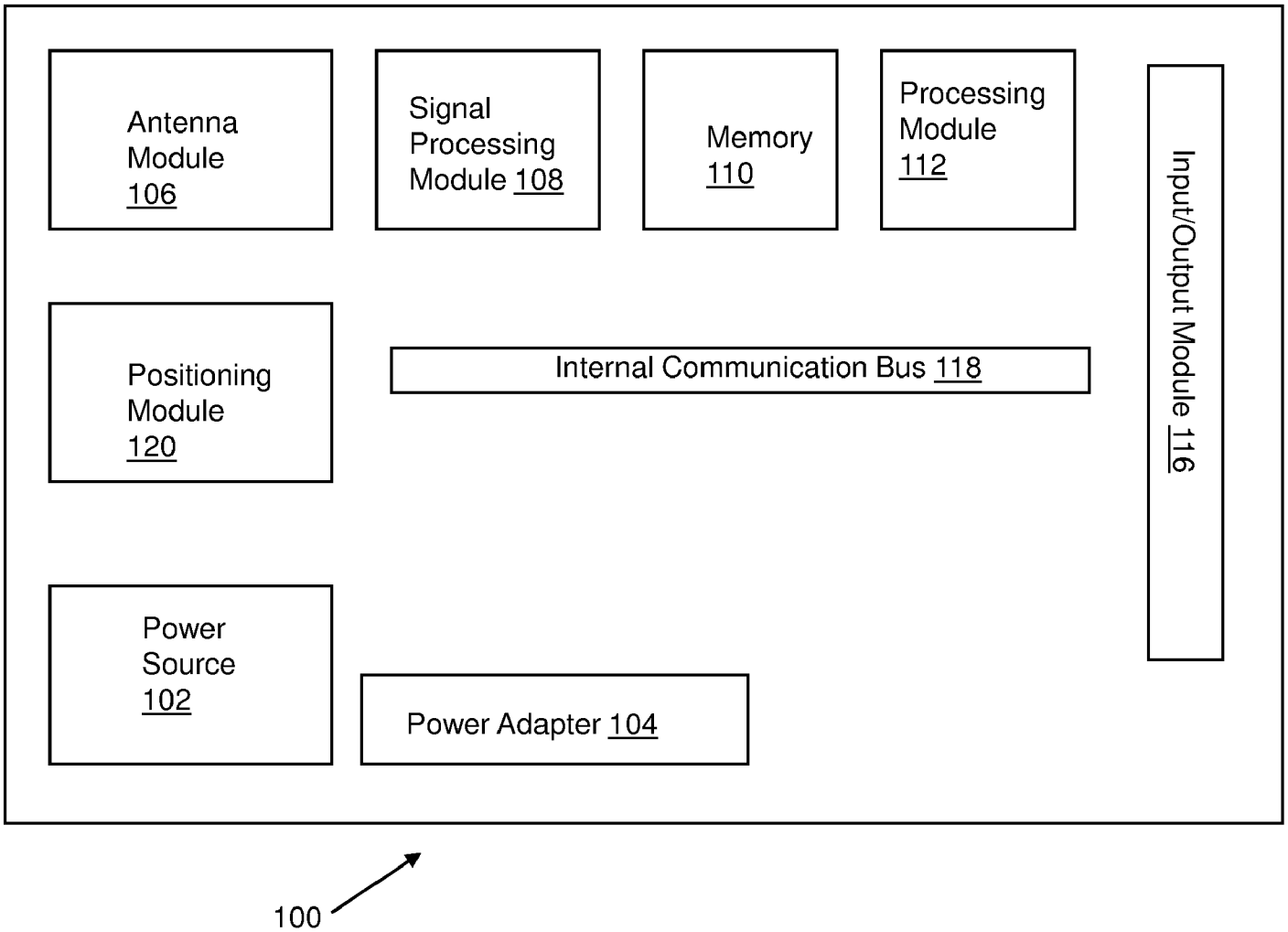
FIG. 3 illustrates a block diagram describing a capsule module that may be used with a pole structure disclosed in FIG. 1 according to one embodiment of the invention.

Referring now to FIG. 3, it illustrates a simplified block diagram of a capsule module 100 that may be used as the capsule module 36 disclosed in FIG. 1. (Hereinafter, the capsule module 36 and capsule module 100 may be used interchangeably). The capsule module 100 may be installed in one or more of the housings 52, 54, and 56. The capsule module 100 may be assembled using one or more printed circuit boards (PCBs) or it may be assembled as a collection of assembled devices. Alternatively, a number of the components of the capsule module 100 described herein may be manufactured as an application specific integrated circuit (ASIC).

In the embodiment illustrated in FIG. 3, the capsule module 100 includes a power source 102 and a power adapter 104. The power source 102 may be a battery source or other portable power source, known to one of skill in the art. The power adapter 104 may be an adapter that provides AC to DC conversion, power management, power surge protection, etc. The power adapter 104 may be removably connected to a power cable. Such a power cable may be provided with the elevating mechanism 30 or with a track mechanism located inside the pole structure 10. In an embodiment, the capsule module 100 may be adapted to periodically measure the power level of the power source 102 and to send the information about the power level to a remote location. Such signals may be communicated wirelessly or using communication cables attached to the capsule module 100.

The capsule module 100 may also include an antenna module 106. The antenna module 106 may be removably attached to the capsule module 100. The antenna module 106 may include one or more antennas used for cellular communication or other types of radio communication. For example, in an embodiment, the antenna module 106 may have an omni-directional antenna attached thereto. In an alternate embodiment, the antenna module 106 may have an array of directional antennas. In a further alternate embodiment, other types of antennas generally used for cellular radio communication may be also be installed.

As known to one of ordinary skill in the art, antennas act as transducers that are designed to transmit or receive electromagnetic waves. The capsule module 100 may also include a signal processing module 108 that may be used to convert the signals generated by the antenna module 106 into one or more digital signals and vice-versa. For example, the signal processing module 108 may include a number of digital signal processors and analog signal processors. In an embodiment of the capsule module 100, the signal processing module 108 may be integrated with the antenna module 106.

The capsule module 100 may also include a memory module 110. The memory module 110 may be a random access memory (RAM), a read-only memory (ROM) or a combination of the two. In an embodiment of the capsule module 100, the memory module 110 may be part of a computing apparatus similar to the one discussed below with respect to FIG. 6. The memory module 110 may be used to store instructions that may be used to manage the capsule module 100, to process signal information received from the signal processing module 108, and/or to store information to be transmitted through the antenna module 106, etc.

Additionally, the capsule module 100 may also include a processing module 112. The processing module 112 may be any commonly available off-the-shelf processor or may be a special purpose processor specifically designed to be used with the capsule module 100. In an embodiment of the capsule module 100, the processing module 112 may be part of a computing apparatus similar to the one discussed below in FIG. 6. The processing module 112 may be used to process information communicated to (received by) or transmitted from the antenna module 106. Additionally, it may also be used to process instructions related to management and/or positioning of the capsule module 100. In an embodiment of the capsule module 100, the processing module 112 may be used to manage a positioning module 120, discussed below, to rotate the capsule module 100 or to rotate the antenna module 106.

While the capsule module 100 may use one or more antenna modules 106 for external communication, additionally, the capsule module 100 may also use an input/output (IO) module 116 for external communication purposes. The IO module 116 may be, for example at least one communication port, such as, but not limited to, an RS-232 communication port, a universal serial bus (USB) port, etc. A user may use the IO port 116 to access the memory module 110, to provide instructions to the processing module 112, etc., from a remote or local location. In one embodiment, the capsule module 100 may be adapted to receive communications through an Ethernet connection in order to send/receive signals to one or more modules on the capsule module 100. A passive optical network (PON) may also be implemented to communicate to/from the capsule module 100.

One or more components of the capsule module 100 described above may be communicatively interconnected with one or more of the other components of the capsule module 100 directly or indirectly via a communication bus 118. Such internal communication bus may be, for example, a parallel bus such as the industry standard architecture (ISA) bus, etc. Alternatively, in some embodiments, various capsule module components may also be directly interconnected with each other via one or more serial buses. Furthermore, one or more components may be integrated with one or more other components.

The positioning module 120 may be a DC motor, an AC motor, etc., that may be used to rotate the capsule module 100 and/or the antenna module 106. The positioning module 120 may receive its instructions from the processing module 112, from the memory module 110, from the IO module 116, etc. In an embodiment of the capsule module 100, the processing module 112 may be designed to analyze the strength of communication signals received by the antenna module 106, and, in response to the analysis, send signals to the positioning module 120 to change the directional position of the capsule module 100 and/or the directional position of the antenna module 106 to increase and/or decrease the strength of one or more communication signals.

While the capsule module 100 described above includes various components such as the memory module 110, the processing module 112, etc., as separate modules, in an alternate embodiment, the capsule module 100 may include a computing apparatus that may include many of the components of the capsule module 100 described in FIG. 3. Such a computing apparatus is described in further detail in FIG. 6 below.

Figure 4:
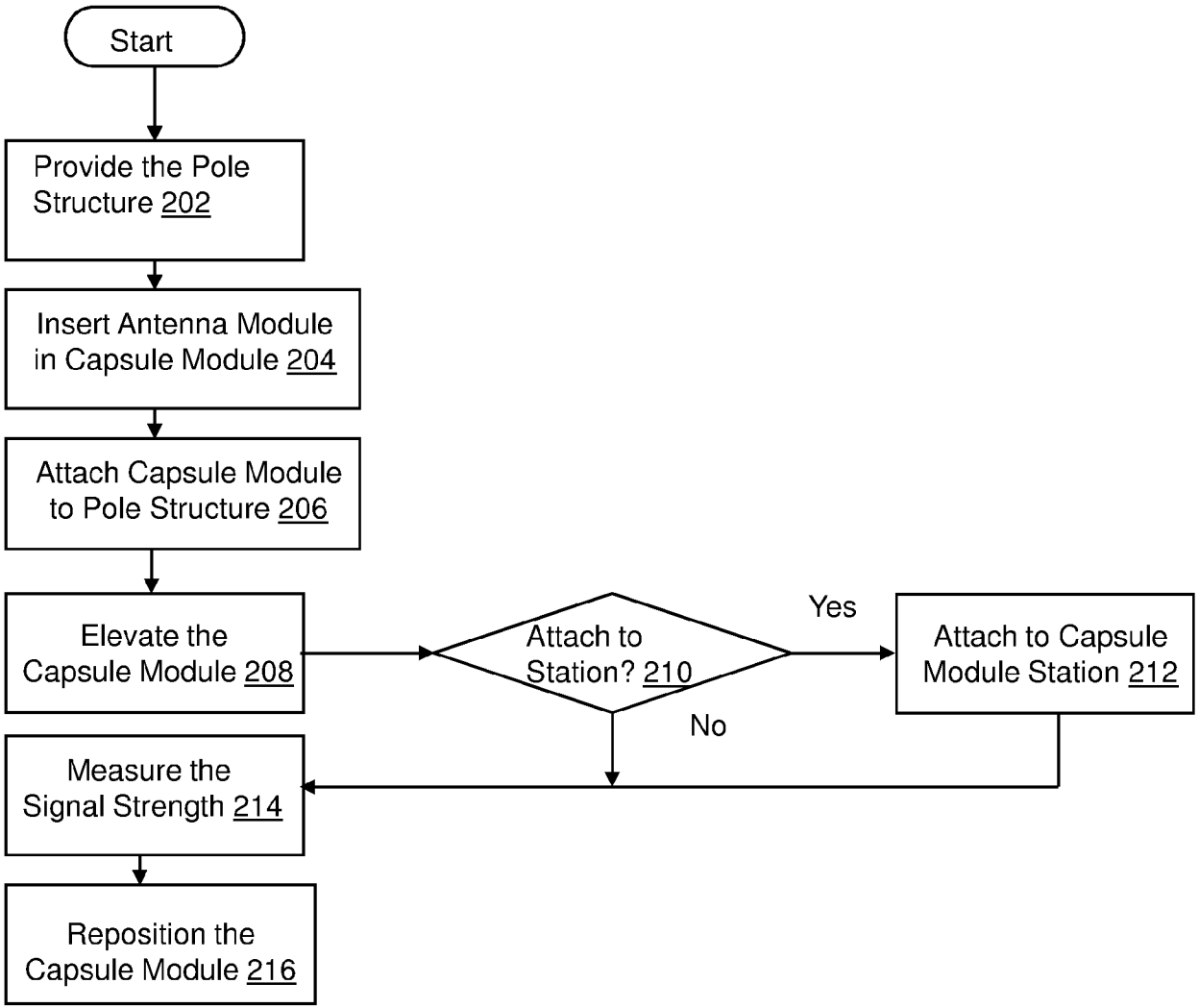
FIG. 4 illustrates a flowchart describing using the pole structure disclosed in FIG. 1 according to one embodiment of the invention.

Referring now to FIG. 4, it illustrates a flowchart 200 describing a method of using the pole structure 10 disclosed in FIG. 1. At a block 202 a pole structure, such as the pole structure 10 is provided. Providing the pole structure 10 may also include providing the aperture 22 at an appropriate location in the wall 20, the door 28, the elevating mechanism 30, etc. In an embodiment of the method of using the pole structure 10, a radome attachment mechanism, such as the hooks 32 may also be provided and a radome may also be attached to the pole structure at block 202.

Subsequently, at a block 204, a user may insert an antenna module 106 to a capsule module 100 to be used with the pole structure 10. For example, an antenna module 106 having an omni-directional antenna may be attached to the capsule module 100. Attaching an antenna module 106 with the pole structure 10 may also further include storing instructions on the memory module 110 or the processing module 112 with respect to management and positioning of the antenna module 106 and the capsule module 100.

Once an antenna module 106 is attached to a capsule module 100, at block 206 the user may attach the capsule module 100 with the elevating mechanism 30. Attaching the capsule module 100 with the elevating mechanism 30 may include mechanical attachment of the capsule module 100 with the elevating mechanism 30, attaching one or more power supplies with the capsule module 100, and attaching one or more communication cables with the capsule module 100. For example, in an embodiment, the lifting cable of the elevating mechanism 30 may be provided with a power cable that may be attached to the power adapter 104 of the capsule module 100.

Subsequently, at a block 208 the user may elevate the capsule module 100 using the elevating mechanism 30. The user may elevate the capsule module 100 manually using the elevating mechanism 30 or by providing instructions to a control system that controls the elevating mechanism 30. For example, in an embodiment, the user may input the desired elevation of the capsule module 100 in such a control system and the control system may elevate the capsule module 100 automatically in response to the desired elevation information.

At block 210, the user may determine if the capsule module 100 is to be attached to a capsule module station, such as the capsule module station 40. If so, at a block 212, the capsule module 100 is detached from the elevating mechanism 30 and attached to the capsule module station 40. Detaching the capsule module 100 from the elevating mechanism 30 may be accomplished with some detachment mechanism provided with the capsule module 100 and the capsule module station 40. For example, in an embodiment of the pole structure, the capsule module station 40 may be provided with a special sensor that detects the proximity of the capsule module 100 to the capsule module station 40 and when the capsule module 100 is at a specific distance from the capsule module station 40, the capsule module station 40 may pull the capsule module 100 towards itself by using a special magnetic pull or other mechanism. At the same time, a signal may be communicated to the capsule module 100 about the detaching of the capsule module 100 from the elevating mechanism. For example, a signal may be transmitted to the capsule module 100 to cause a clamp holding the capsule module 100 together with the elevating mechanism to be released when the capsule module 100 has attached to the capsule module station 40. As one of skill in the art would know, other mechanisms of detaching the capsule module 100 from the elevating mechanism 30 and attaching it to the capsule module station 40 may also be used.

As discussed above, the pole structure 10 may be provided with multiple capsule module stations 40 so that multiple capsule modules 100 may be located towards the top end 24 of the pole structure 10. Providing the capsule module station 40 and the method of detaching the capsule module 100 from the elevating mechanism 30 and attaching it to the capsule module station 40 allows a user to attach a number of capsule modules 100, each having its own antennas, in a single pole structure 10. If the pole structure 10 does not have any capsule module stations 40, a multiple number of capsule modules 100 may be left attached to the elevating mechanism 30.

Subsequently, at a block 214, for each capsule module station 40 installed in the pole structure 10, the processing unit 112, together with the antenna module 106 and the signal processing module 108 may undertake a process to measure the strength of signal received by the antenna module 106. Such measurements may be used to determine the optimal position (including elevational position, rotational position, and angular position) of the capsule module 100 and to determine the optimal position of various antennas in the antenna module 106. To get such measurements, one or more sets of instructions stored on the memory module 110 or the processing module 112 may cause the antennas on the antenna modules 106 to be activated and to detect a cellular or other radio signal of known signal strength, such as, but not limited to, one generated by a nearby base transceiver station (BTS), mobile switching center (MSC), or base station controller (BSC). Once the signal captured by the antenna module 106 is processed by the signal processing module 108, the actual strength of the received signal is compared with the expected strength of the received signal.

Based on the result of the comparison, at a block 216 the capsule module is repositioned. Note that even though in FIG. 4 the blocks 214 and 216 are shown as occurring only once, in practice the process of positioning the capsule module 100 and/or the antenna module 106 in optimal position may be iterative using a feedback process. Also, in an alternative embodiment, one or more of the blocks/processes discussed above may be performed in an alternate order. Moreover, while the above blocks are described with respect to the pole structure 10 described in FIG. 1, these steps may also be used with respect to the alternate pole structure described below in FIG. 5.

Figure 5:
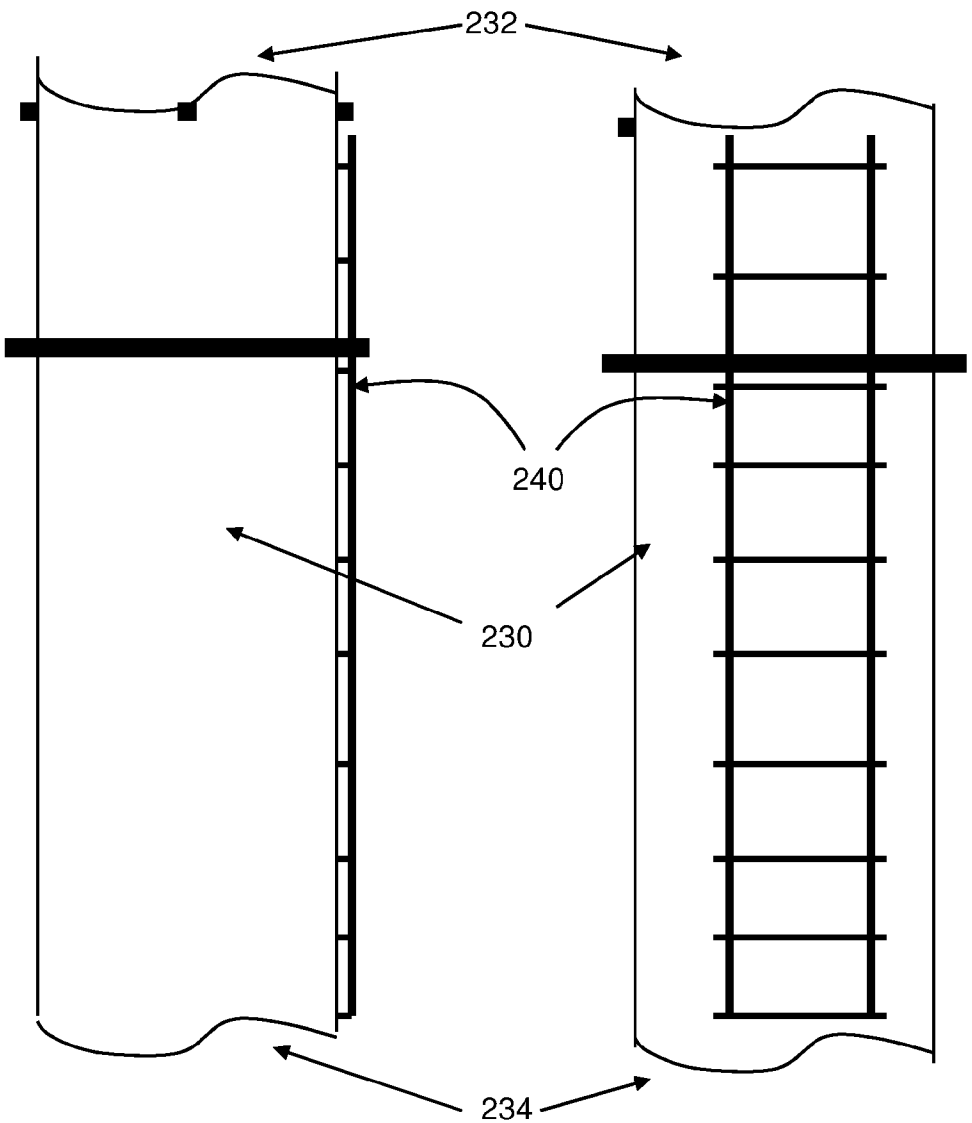
FIG. 5 illustrates a block diagram of a pole structure for an antenna installation according to another embodiment of the invention.

Referring now to FIG. 5, it illustrates a simplified elevation view and a side view of an alternative structure of the pole structure for antenna installation. In this embodiment, the pole structure 230 is a solid pole with a top end 232 and base end 234. An elevating mechanism 240 is installed on the outer surface of the pole structure 230. The elevating mechanism 240 may be a track and ring mechanism including one or more tracks adapted to move one or more rings along the length of the pole structure 230. Alternatively, the elevating mechanism 240 may be a pulley and cable or a pulley and rope mechanism similar to the one discussed above with respect to FIG. 1, or any other elevating mechanism described above or known in the art. The pole structure 230 may also provide a radome attachment mechanism near the top end 232 that may removably attach to a radome. In an alternate embodiment, a combination of the pole structure 10 and the pole structure 230 may also be provided, which may have both an internal elevating mechanism and an external elevating mechanism, or a single elevating mechanism that is partially located internally and externally to the pole structure 230, 10.

Figure 6:
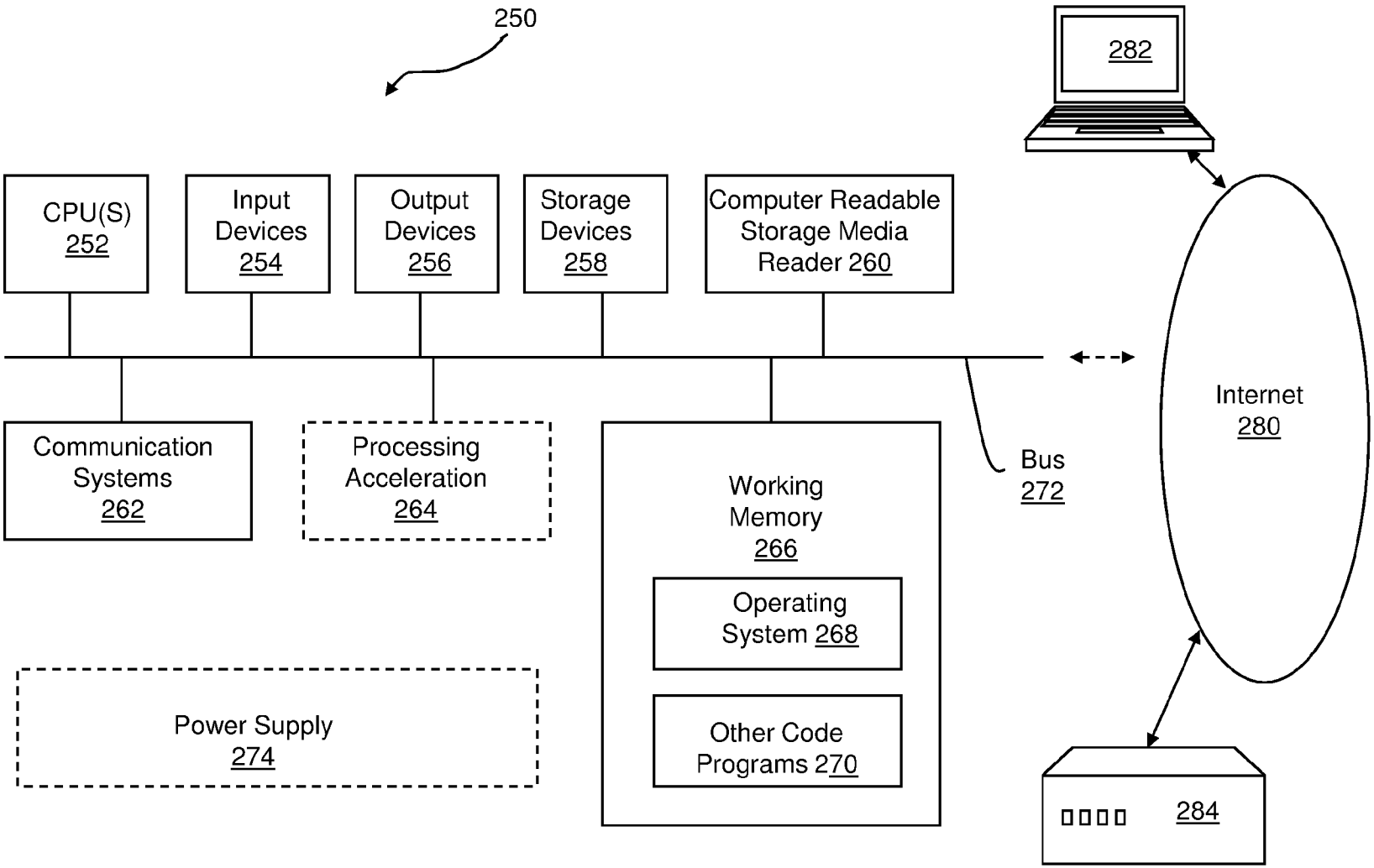
FIG. 6 illustrates a block diagram of a computing apparatus that may be used with one or more pole structures, according to one embodiment of the invention.

Turning now to FIG. 6, it illustrates a block diagram of an exemplary computing apparatus 250 that may be used for implementing embodiments of the present invention. In an alternate embodiment, the capsule module 100 may include such a computing apparatus 250. This example illustrates a computing apparatus 250 such as may be used, in whole, in part, or with various modifications, to provide a server, manager, end device, a billing engine, or other systems such as those discussed above.

The computing apparatus 250 is shown comprising hardware elements that may be electrically or wirelessly coupled via a bus 272. The hardware elements may include one or more central processing units (CPUs) 252, one or more input devices 254 (e.g., a mouse, a keyboard, etc.), and one or more output devices 256 (e.g., a display device, a printer, etc.). The computing apparatus 250 may also include one or more storage devices 258. By way of example, storage devices 258 may be disk drives, optical storage devices, a solid-state storage device such as a random access memory ("RAM") and/or a read-only memory ("ROM"), which can be programmable, flash-updateable and/or the like.

The computing apparatus 250 may additionally include a computer-readable storage media reader 260, a communications system 262 (e.g., a modem, a network card (wireless or wired), an infra-red communication device, etc.), and working memory 266, which may include RAM and ROM devices as described above. In some embodiments, the computing apparatus 250 may also include a processing acceleration unit 264, which can include a DSP, a special-purpose processor and/or the like. The various components of the computing apparatus 250 may be powered by the power supply 274, which may include internal and/or external power sources.

The computer-readable storage media reader 260 can further be connected to a computer-readable storage medium, together (and, optionally, in combination with storage device(s) 258) comprehensively representing remote, local, fixed, and/or removable storage devices plus storage media for temporarily and/or substantially permanently containing computer-readable information. The communications system 262 may permit data to be exchanged with a network and/or any other computer(s).

The computing apparatus 250 may also comprise software elements, shown as being currently located within a working memory 266, including an operating system 268 and/or other code 270. For example, one of more of the various methods of providing advertising, initiating phone calls, maintaining track of the revenues generated by the advertising, etc., may be implemented by special programs stored in the other code 270. Software of computing apparatus 250 may include code for implementing any or all of the function of the various elements of the architecture as described herein. Methods implemented by software on some of these components will be discussed in detail below.

It should be appreciated that alternate embodiments of a computing apparatus 250 may have numerous variations from that described above. For example, customized hardware might also be used and/or particular elements might be implemented in hardware, software (including portable software, such as applets), or both. Further, connection to other computing devices such as network input/output devices may be employed and part of the software or hardware may be distributed between various computers/servers over a network. For example, in an embodiment of the computing apparatus 250, the bus 272 may be connected to an external communication bus connected to a network such as the Internet 280. Thus, one or more of the software modules implementing the systems and methods described herein may be located on a network computer 282. Similarly, some of the data and/or programs may be stored on a network storage device 284.

It will be apparent to those skilled in the art that substantial variations may be made in accordance with specific requirements to all of the systems, methods, software, and other embodiments described above. For example, customized hardware might also be used, and/or particular elements might be implemented in hardware, software (including portable software, such as applets, etc.), or both. Further, connection to other computing devices such as network input/output devices may be employed.

While the invention has been described herein with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods of the invention are not limited to any particular structural and/or functional architecture but instead can be implemented on any suitable hardware, firmware, and/or software configuration. Similarly, while various functionalities are ascribed to certain system components, unless the context dictates otherwise, this functionality can be distributed among various other system components in accordance with different embodiments of the invention.

Moreover, while the procedures comprised in the methods and processes described herein are described in a particular order for ease of description, unless the context dictates otherwise, various procedures may be reordered, added, and/or omitted in accordance with various embodiments of the invention. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary features, the various components and/or features described herein with respect to a particular embodiment can be substituted, added, and/or subtracted from among other described embodiments, unless the context dictates otherwise. Consequently, although the invention has been described with respect to exemplary embodiments, it will be appreciated that the invention is intended to cover all modifications and equivalents within the scope of the following claims.

What is claimed is:

1. An apparatus for enabling installation of antenna equipment, the apparatus comprising:

a hollow pole having a base end and a top end, the base end and the top end being opposite each other;

an aperture located along a side of the hollow pole;

an elevating mechanism located inside the hollow pole; and a capsule for holding an antenna equipment, the capsule being insertable through the aperture and being removably attachable to the elevating mechanism, wherein the capsule further comprises:

a removable power source;

a memory module for storing information about axial position of the capsule; and an axial rotation module configured to rotate the capsule around an axis based on the information about axial position of the capsule.

2. The apparatus of claim 1, wherein the elevating mechanism comprises a pulley mechanism.

3. The apparatus of claim 2, wherein the pulley mechanism further comprises at least one of a rope; a cable; a belt; and a chain.

4. The apparatus of claim 1, wherein the elevating mechanism comprises a gear mechanism.

5. The apparatus of claim 1, further comprising a radome attached at the top end of the hollow pole.

6. The apparatus of claim 1, wherein the elevating mechanism is further configured to move the capsule from near the base end to near the top end.

7. The apparatus of claim 6, further comprising an elevation control mechanism attached to the elevating mechanism, wherein the elevation control mechanism is configured to receive elevational information and to move the capsule in response to the elevational information.

8. The apparatus of claim 1, wherein the capsule is further configured to rotate around a central axis in response to rotation commands.

9. The apparatus of claim 1, further comprising a support base for the pole, the support base being attachable to the base end of the hollow pole, wherein the support base is configured to host at least one of a power source; and a transceiver equipment.

10. The apparatus of claim 9, wherein the capsule is further configured to attach to a power cable, wherein the power cable is attached to the power source located at the support base.

11. The apparatus of claim 9, wherein the capsule is further configured to attach to a telecommunications network via a communications cable, the communication cable attached to the transceiver equipment located at the support base.

12. The apparatus of claim 1, further comprising a capsule mounting socket attached to an inner surface of the hollow pole, wherein the capsule mounting socket is configured to removably attach the capsule to the hollow pole.

13. The apparatus of claim 1, wherein the memory module is further configured to store information about elevation position of the capsule and to transmit the information about elevation position to the elevating mechanism.

14. The apparatus of claim 1, wherein the capsule further comprises a communication device configured to allow a user to send signals to the capsule and receive signals from the capsule.

15. The apparatus of claim 14, wherein the communications device comprises an input/output module configured to access a passive optical network.

16. An apparatus for enabling installation of antenna equipment, the apparatus comprising:

a hollow pole having a base end and a top end, the base end and the top end being opposite each other;

an aperture located along a side of the hollow pole;

an elevating mechanism located inside the hollow pole; and a capsule for holding an antenna equipment, the capsule being insertable through the aperture and being removably attachable to the elevating mechanism, wherein the capsule further comprises a removable power source and a signaling mechanism that measures the power level of the removable power source and transmits a signal including information about the power level measurement.

17. A method of installing an antenna, the method comprising:

providing a hollow pole having a base end, a top end and, an aperture located along a side of the hollow pole, and an elevating mechanism inside the hollow pole;

inserting a first antenna in a first capsule;

inserting the first capsule into the hollow pole through the aperture;

attaching the first capsule to the elevating mechanism;

elevating the first capsule from near the base end of the hollow pole to near the top end of the hollow pole;

transmitting rotation commands to the first capsule;

rotating the first capsule around an axis in response to the rotation commands received by the first capsule; and receiving a request for information about the first capsule's axial position; and in response to the request, transmitting information the first capsule's axial position.

18. The method of claim 17, further comprising, detaching the first capsule from the elevating mechanism; and attaching the first capsule to a first bracket located inside the hollow pole.

19. The method of claim 18, further comprising:

inserting a second antenna in a second capsule;

inserting the second capsule into the hollow pole through the aperture;

attaching the second capsule to the elevating mechanism; and elevating the second capsule from near the base end of the hollow pole to near the top end of the hollow pole.

20. The method of claim 18, further comprising, communicating with the first capsule from a remote location via a passive optical network.

21. The method of claim 17, further comprising attaching a radome to the top end of the hollow pole.

22. The method of claim 17, wherein the elevating mechanism comprises at least one of a pulley and cable mechanism and a pulley and belt mechanism.

23. A method of installing an antenna, the method comprising:

providing a hollow pole having a base end, a top end and, an aperture located along a side of the hollow pole, and an elevating mechanism inside the hollow pole;

inserting a first antenna in a first capsule;

inserting the first capsule into the hollow pole through the aperture;

attaching the first capsule to the elevating mechanism;

elevating the first capsule from near the base end of the hollow pole to near the top end of the hollow pole;

providing a memory module attached to the first capsule;

providing an axial rotation module attached to the first capsule;

storing axial position instructions on the memory module;

transmitting the axial position instructions to the axial rotation module; and rotating the first capsule around the axis in response to the axial position instructions.

24. The method of claim 23, further comprising:

storing elevation position instructions on the memory module;

transmitting the elevation position instructions to the elevating mechanism; and changing the elevation of the first capsule in response to the elevation position instructions.

25. A method of installing an antenna, the method comprising:

providing a hollow pole having a base end, a top end and, an aperture located along a side of the hollow pole, and an elevating mechanism inside the hollow pole;

inserting a first antenna in a first capsule;

inserting the first capsule into the hollow pole through the aperture;

attaching the first capsule to the elevating mechanism;

elevating the first capsule from near the base end of the hollow pole to near the top end of the hollow pole;

attaching a removable power source to the first capsule;

generating a signal regarding the power level of the removable power source; and transmitting the signal regarding the power level.

* * * * *